US009545807B2

(12) United States Patent
Kokura

(10) Patent No.: US 9,545,807 B2
(45) Date of Patent: Jan. 17, 2017

(54) POST-PROCESSING APPARATUS AND IMAGE FORMING SYSTEM

(71) Applicant: Konica Minolta, Inc., Chiyoda-ku (JP)

(72) Inventor: Yasuhide Kokura, Toyohashi (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 444 days.

(21) Appl. No.: 14/260,454

(22) Filed: Apr. 24, 2014

(65) Prior Publication Data

US 2014/0319195 A1 Oct. 30, 2014

(30) Foreign Application Priority Data

Apr. 24, 2013 (JP) ..... 2013-091050

(51) Int. Cl.
*B41L 43/12* (2006.01)
*B41L 43/02* (2006.01)
(Continued)

(52) U.S. Cl.
CPC ..... *B41L 43/12* (2013.01); *B41L 43/02* (2013.01); *B65H 31/02* (2013.01); *B65H 45/18* (2013.01);
(Continued)

(58) Field of Classification Search
CPC ..... B41L 43/00; B41L 43/02; B41L 43/10; B41L 43/12; G03G 15/6552; G03G 2215/0042; B65H 31/02; B65H 31/06; B65H 2801/27
See application file for complete search history.

(56) References Cited

U.S. PATENT DOCUMENTS 5,125,215 A * 6/1992 Orsinger ..... B43M 3/045 53/381.6
5,385,340 A * 1/1995 Hiroi ..... B42C 1/12 270/58.13
(Continued)

FOREIGN PATENT DOCUMENTS

JP 1-299163 A 12/1989
JP 5-270078 A 10/1993
(Continued)

OTHER PUBLICATIONS

First Office Action issued in corresponding Chinese Patent Application No. 201410168321.2, dated Nov. 25, 2015; with English Translation (18 pages).
(Continued)

*Primary Examiner* — Christopher Harmon
(74) *Attorney, Agent, or Firm* — Buchanan Ingersoll & Rooney PC

(57) ABSTRACT

A post-processing apparatus configured to collect printed sheets ejected from an image forming apparatus and to handle the printed sheets. The post-processing apparatus has: a stacker configured to collect and stack a plurality of printed sheets with one end of each of the printed sheets placed down; a movable stopper configured to stop each of the printed sheets sliding down in the stacker at a specified position; a motor configured to move the stopper along the stacker and stops the stopper; and a control unit configured to control the motor. The control unit increases a current supplied to the motor in preparation for a collision between each of the printed sheets and the stopper.

16 Claims, 15 Drawing Sheets

(51) Int. Cl.

| | |
|---|---|
| ***G03G 15/00*** | (2006.01) |
| ***B65H 31/02*** | (2006.01) |
| ***B65H 45/18*** | (2006.01) |

(52) U.S. Cl.
CPC ..... *G03G 15/6544* (2013.01); *G03G 15/6552* (2013.01); *B65H 2301/4213* (2013.01); *B65H 2301/42146* (2013.01); *B65H 2405/221* (2013.01); *B65H 2511/10* (2013.01); *B65H 2513/10* (2013.01); *B65H 2515/10* (2013.01); *B65H 2515/112* (2013.01); *B65H 2515/704* (2013.01); *B65H 2801/27* (2013.01); *G03G 2215/00421* (2013.01); *G03G 2215/00827* (2013.01)

(56) References Cited

U.S. PATENT DOCUMENTS

| | | | | |
|---|---|---|---|---|
| 7,021,616 | B2 * | 4/2006 | Mizuta | G03G 15/6538 270/58.08 |
| 7,537,556 | B2 * | 5/2009 | Bober | B65H 45/18 493/23 |
| 7,597,311 | B2 * | 10/2009 | Kawata | B65H 45/18 270/12 |
| 7,946,568 | B2 * | 5/2011 | Hayashi | B65H 37/04 270/32 |
| 8,851,464 | B2 * | 10/2014 | Shimizu | G03G 15/6544 270/32 |
| 2007/0025768 | A1 | 2/2007 | Komatsu et al. | |
| 2009/0267291 | A1 | 10/2009 | Tabata | |

FOREIGN PATENT DOCUMENTS

| | | | |
|---|---|---|---|
| JP | 2001-031314 | A | 2/2001 |
| JP | 2002-234660 | A | 8/2002 |
| JP | 2005-314029 | A | 11/2005 |
| JP | 2006-085153 | A | 3/2006 |
| JP | 2008-105792 | A | 5/2008 |
| JP | 2012-212169 | A | 11/2012 |

OTHER PUBLICATIONS

Office Action (Notification of Reasons for Rejection) issued on Mar. 17, 2015, by the Japanese Patent Office in corresponding Japanese Patent Application No. 2013-091050 and an English translation of the Office Action. (6 pages).

Office Action (Second Office Action) issued on Aug. 25, 2016, by the State Intellectual Property Office of the People's Republic of China in corresponding Chinese Patent Application No. 201410168321.2, and English Translation of the Office Action. (22 pages).

* cited by examiner

| SHEET FEEDING SPEED | SHEET SIZE | GRAMMAGE | Ii |
|---|---|---|---|
| 250mm/s | A4S | 60g/m² | +2 steps |
| | | 120g/m² | +4 steps |
| | A3 | 60g/m² | +4 steps |
| | | 120g/m² | +8 steps |
| 500mm/s | A4S | 60g/m² | +4 steps |
| | | 120g/m² | +8 steps |
| | A3 | 60g/m² | +8 steps |
| | | 120g/m² | +16 steps |

| SHEET FEEDING SPEED | SHEET SIZE | GRAMMAGE | I1 | Ii-I1 |
|---|---|---|---|---|
| 250mm/s | A4S | 60g/m² | +1 step | +1 step |
| | | 120g/m² | +2 steps | +2 steps |
| | A3 | 60g/m² | +2 steps | +2 steps |
| | | 120g/m² | +4 steps | +4 steps |
| 500mm/s | A4S | 60g/m² | +1 step | +3 steps |
| | | 120g/m² | +2 steps | +6 steps |
| | A3 | 60g/m² | +2 steps | +6 steps |
| | | 120g/m² | +4 steps | +12 steps |

POST-PROCESSING APPARATUS AND IMAGE FORMING SYSTEM

This application claims priority to Japanese Patent Application No. 2013-091050 filed on Apr. 24, 2013, the content of which is incorporated herein by reference.

BACKGROUND OF THE INVENTION

1. Field of the Invention

The present invention relates to a post-processing apparatus and an image forming system, and more particularly to a post-processing apparatus configured to collect printed sheets ejected from an image forming apparatus and to handle the printed sheets, and an image forming system comprising the post-processing apparatus.

2. Description of Related Art

As a post-processing apparatus for collecting and handling printed sheets ejected from an image forming apparatus, for example, a sheet post-processing apparatus disclosed by Japanese Patent Laid-Open Publication No. 2005-314029 is known. Such a conventional sheet post-processing apparatus is described with reference to FIGS. 14 and 15.

As shown by FIG. 14, the sheet post-processing apparatus 500B is to handle, for example, fold and/or staple sheets P ejected from an image forming apparatus 500A, and the sheet post-processing apparatus 500B is connected to the image forming apparatus 500A. The sheet post-processing apparatus 500B comprises a sheet feeding unit 600, and the sheet feeding unit 600 comprises an intermediate stacker 700.

As shown by FIG. 15, the intermediate stacker 700 comprises guide plates 562A and 562B, a sheet stopper 563, and a friction member 565. The guide plates 562A and 562B are opposed to each other and are arranged vertically. At the bottom of the guide plates 562A and 562B, the sheet stopper 563 and the friction member 565 are located. The sheet stopper 563 is movable to adjust its position to the sheet size.

The intermediate stacker 700 of the structure above temporarily stores therein the sheets P to be handled, for example, to be folded and/or stapled. Specifically, each sheet P introduced into the sheet post-processing apparatus 500B through an entrance 510 passes through entrance rollers 511, feed rollers 517 and a sheet path r502 and enters an area between the guide plates 562A and 562B. Then, the sheet P slides down along the guide plates 562A and 562B and is stopped by the sheet stopper 563. In this way, sheets P are collected and stored in the intermediate stacker 700.

At this stage, if the sheet P slides down too fast, the stopper 563 may be pushed down by the impact of a collision of the sheet P with the stopper 563. In order to avoid this trouble, in the intermediate stacker 700, the friction member 565 is located immediately above the sheet stopper 563. The sheet P sliding down along the guide plates 562A and 562B comes into contact with the friction member 565 before hitting against the sheet stopper 563. Thereby, the sliding sheet P slows down, and a fall of the stopper 563 due to the collision of the sheet P can be avoided.

In the method of slowing down the sliding sheet P by use of the friction member 565, however, the degree of slowing-down changes depending on the coefficient of friction of the surface of the friction member 565, the size and the grammage of the sheet P, etc. Therefore, the intermediate stacker 700 has a problem that there may be cases in which the sheet P does not reach the stopper 563 when the grammage of the sheet P is small or when the coefficient of friction of the friction member 565 is high.

SUMMARY OF THE INVENTION

The present invention provides a post-processing apparatus and an image forming system capable of preventing a stopper provided in a printed sheet stacker from falling without using any members for slowing down a printed sheet ejected from an image forming apparatus.

A first aspect of the present invention provides a post-processing apparatus configured to collect printed sheets ejected from an image forming apparatus and to handle the printed sheets, and the post-processing apparatus comprises: a stacker configured to collect and stack a plurality of printed sheets with one end of each of the printed sheets placed down; a movable stopper configured to stop each of the printed sheets sliding down in the stacker at a specified position; a motor configured to move the stopper along the stacker and stops the stopper; and a control unit configured to control the motor. The control unit increases a current supplied to the motor in preparation for a collision between each of the printed sheets and the stopper.

A second aspect of the present invention provides an image forming system comprising: an image forming apparatus configured to form images on a plurality of printed sheets sequentially; a post-processing apparatus configured to collect printed sheets ejected from an image forming apparatus and to handle the printed sheets; and a control unit configured to control the motor. The post-processing apparatus comprises: a stacker configured to collect and stack a plurality of printed sheets with one end of each of the printed sheets placed down; a movable stopper configured to stop each of the printed sheets sliding down in the stacker at a specified position; and a motor configured to move the stopper along the stacker and stops the stopper. The control unit increases a current supplied to the motor in preparation for a collision between each of the printed sheets and the stopper.

DETAILED DESCRIPTION OF THE PREFERRED EMBODIMENTS

General Structure of the Image Forming System and the Post-Processing Apparatus An image forming system 1 and a post-processing apparatus 3 according to an embodiment of the present invention will be hereinafter described with reference to the drawings.

Figure 1:
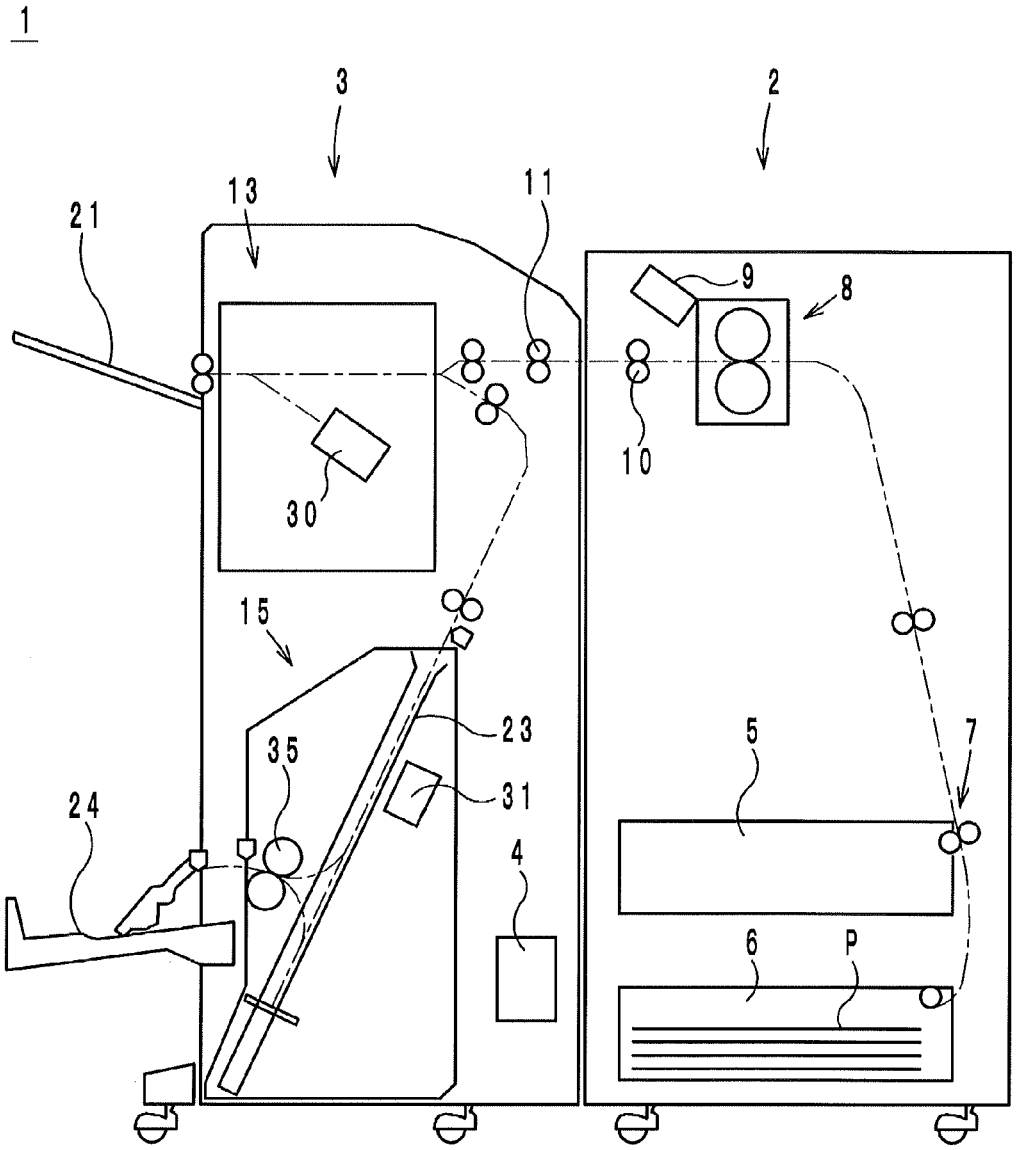
FIG. 1 is a schematic view showing the internal structure of an image forming system according to an embodiment of the present invention.

As shown by FIG. 1, the image forming system 1 comprises an image forming apparatus 2 and a post-processing apparatus 3. The image forming apparatus 2 comprises an image formation unit 5 for forming a toner image by a conventional electrophotographic process, and at a transfer section 7, transfers the toner image to a sheet P fed from a sheet feeder unit 6. The image formation unit 5 may be a unit for forming a full-color toner image or for forming a monochromatic toner image. When the image formation unit 5 is a full-color image formation unit, the unit may adopt a tandem method or a four-cycle method. The sheet P after receiving a toner image at the transfer section 7 is subjected to a heating process in a fixing unit 8 such that the toner can be fixed on the sheet. Thereafter, the sheet P is cooled by a cooling fan 9 and is ejected from the image forming apparatus 2 through a pair of ejection rollers 10.

The post-processing apparatus 3 comprises a main tray 21, a brochure tray 24, a flat stapling unit 13, a center stapling/folding unit 15, and a control unit 4 for controlling all of the sections of the post-processing apparatus 3. The post-processing apparatus 3 is to handle printed sheets P ejected from the image forming apparatus 2 and ejects the handled sheets P to the main tray 21 or the brochure tray 24. More specifically, the post-processing apparatus 3 receives printed sheets P from the image forming apparatus 2 at a pair of receiving rollers 11, and the post-processing apparatus 3 is operable in a mode in which the sheets P are fed to the flat stapling unit 13 and in a mode in which the sheet path is switched to feed the sheets P downward to the center stapling/folding unit 15. The sheets P fed to the flat stapling unit 13 are ejected to the main tray 21 one by one or are stapled by a stapler provided in the flat stapling unit 13 and ejected to the main tray 21. The sheets P fed to the center stapling/folding unit 15 are collected in a stacker 23. Thereafter, the sheets P are stapled by a stapler 31, and the stapled set of sheets P is folded in two by a pair of folding rollers 35. The stapled and folded set of sheets P is ejected to the tray 24. When the sheets P are to be only folded, the sheets P are folded in two and ejected to the tray 24 without undergoing a stapling process by the stapler 31.

Detailed Description of the Center Stapling/Folding Unit

Figure 2:
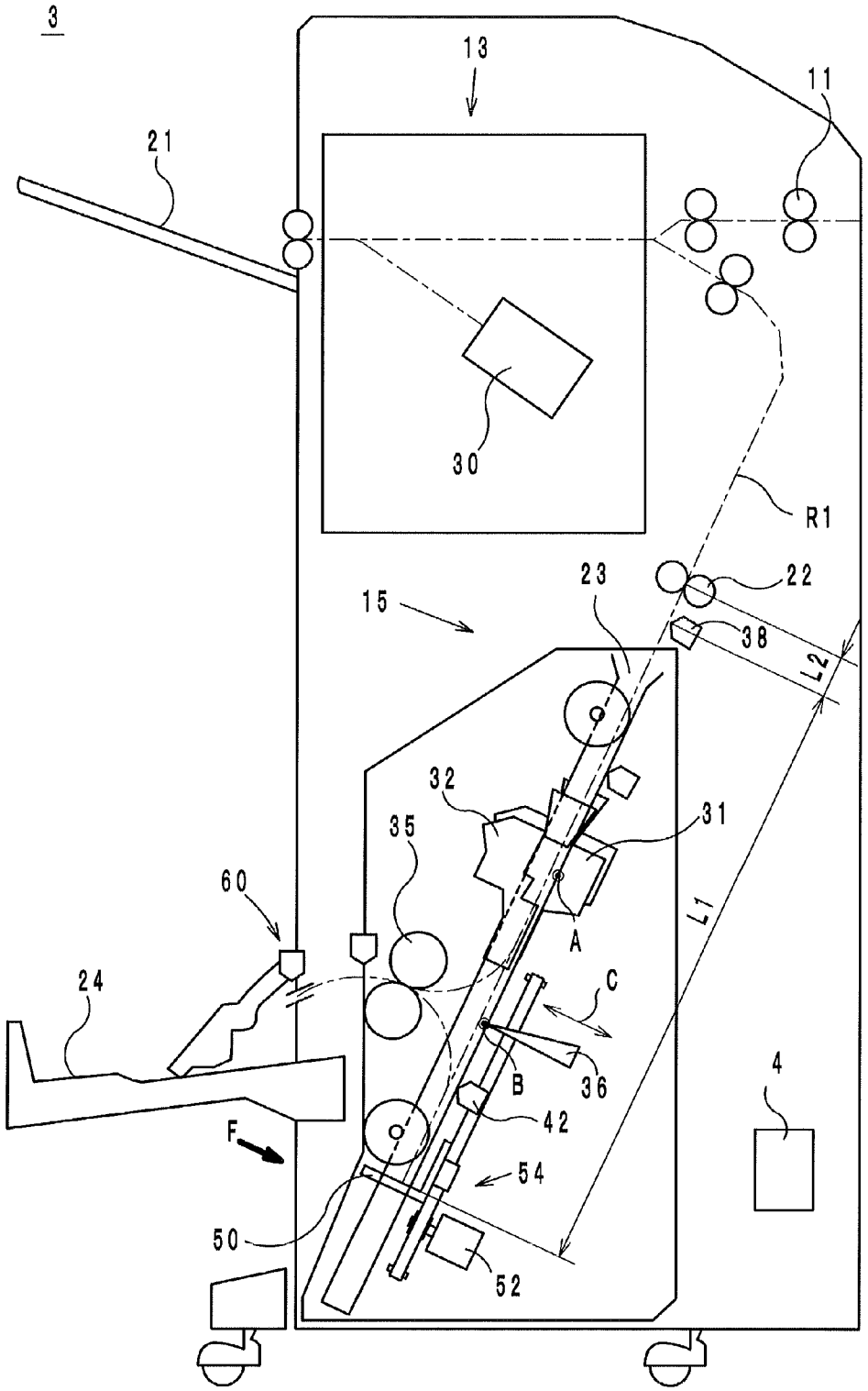
FIG. 2 is an illustration showing a sheet stacking process and a stapling process in a post-processing apparatus.

As shown in FIG. 2, the center stapling/folding unit 15 comprises a pair of entrance rollers 22, a stacker 23, a center stapler 31, a saddle aligning plate 32, a pair of folding rollers 35, a folding knife 36, an entrance sensor 38, an ejection sensor 42, a stopper 50, a motor 52 for moving (up and down) the stopper 50, and a drive force transmission 54.

The sheet P introduced into a route R1 is fed through the entrance rollers 22 and stored in the stacker 23 set almost vertically. At this moment, the lower edge of the sheet P hits against the stopper 50 in the stacker 23 to be placed in a specified position in the stacker 23. Next, the sheet P is positioned in the widthwise direction by the saddle aligning plate 32. Thereafter, further sheets P are successively fed into the stacker 23 one by one, and the sheets P are stored in the stacker 23 while being positioned by the stopper 50 such that the centers thereof are located at a staple position A. Then, the stored sheets P are center-stapled by the stapler 31. When the sheets P are to be only folded, the stapling process is omitted.

The center-stapled set of sheets P is moved down in the stacker 23 and is positioned by the stopper 50 such that the center of the set of sheets P in the sheet-feeding direction is located at a folding position B. The folding knife 36 and the folding rollers 35 cooperate to fold the set of sheets P in two, and thereby, the set of sheets P is made into a brochure. Specifically, with movements of the folding knife 36 in directions shown by arrow C, the set of sheets P is folded at the center and is inserted into the nip portion between the folding rollers 35, and with rotation of the folding rollers 35, the set of sheets P is nipped between the folding rollers 35. The folded set of sheets P passes through the nip portion between the folding rollers 35 and is ejected onto the tray 24 via an ejection port 60 of the post-processing apparatus 3.

Connection Between the Stopper and the Motor

Figure 3:
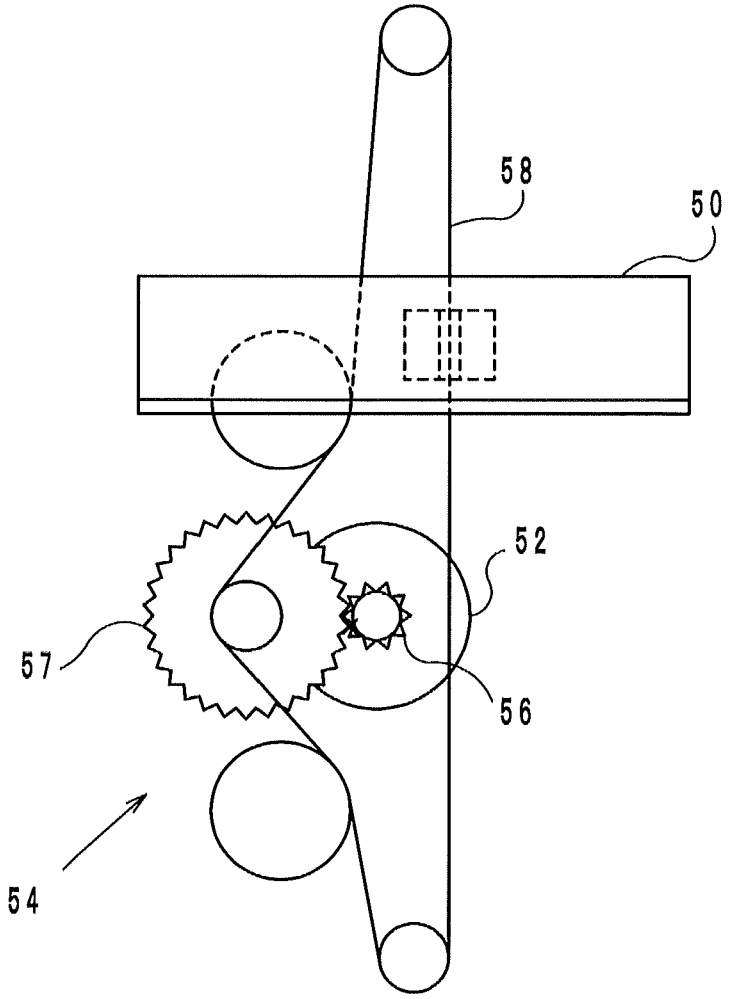
FIG. 3 is a view of a stopper, a motor and a drive force transmission when viewed in a direction shown by arrow F in FIG. 2.

The stopper 50 and the motor 52 are connected to each other by the drive force transmission 54 as shown by FIG. 3. The drive force transmission 54 comprises gears 56, 57 and a belt 58. The gear 56 is fitted to the motor 52 to transmit the output of the motor 52 to the gear 57. The gear 57 is connected to the belt 58 to transmit the output of the motor 52 to the belt 58. The belt 58 is connected to the stopper 50. In this structure, the stopper 50 is moved and stopped in accordance with the output of the motor 52. In this embodiment, the motor 52 is a stepping motor.

Movements of the Stopper and the Motor

Figure 4:
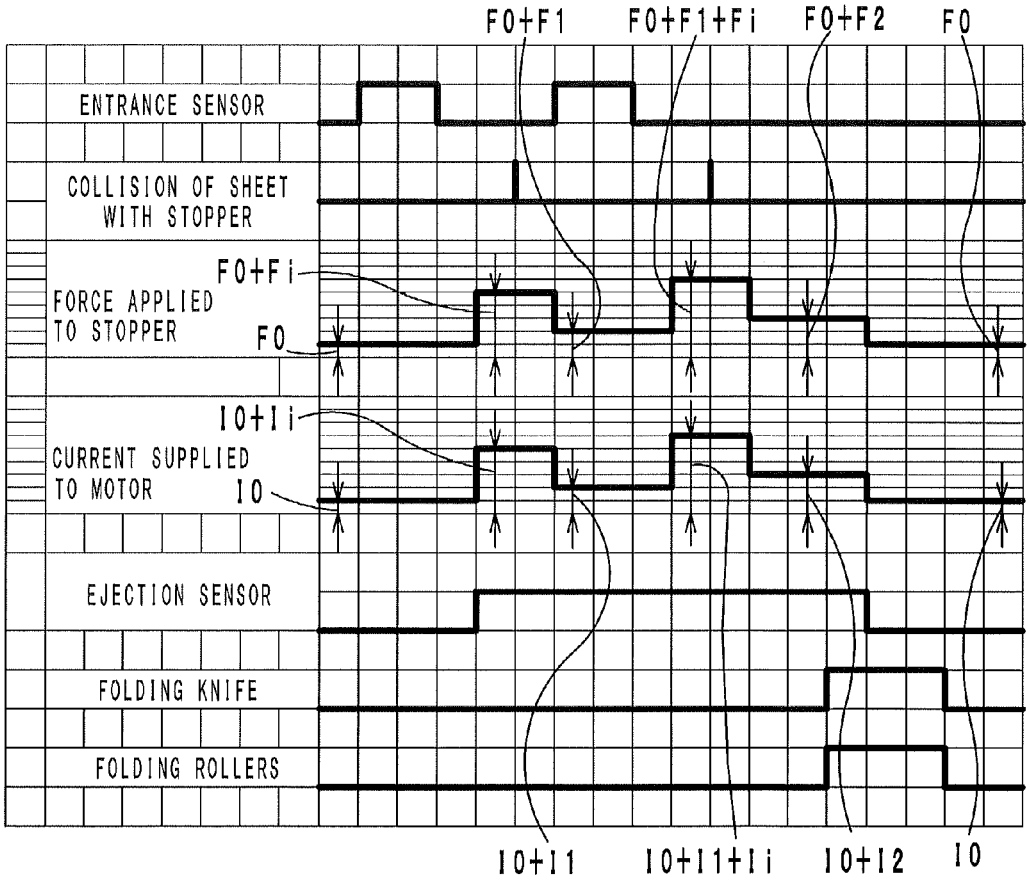
FIG. 4 is a timing chart showing operations of the stopper and the motor.

In response to a center stapling/folding command, first, an electric current is supplied to the motor 52. Thereby, the stopper 50 is moved and stopped at a specified position. At this moment, as shown in FIG. 4, a force F0 corresponding to the weight of the stopper 50 is applied from the motor 52 to the stopper 50.

Next, the lower edge of a sheet P introduced into the center stapling/folding unit 15 collides with the stopper 50. As shown in FIG. 4, in order to prevent the stopper 50 from sliding down at the time of the collision between the sheet P and the stopper 50, an electric current that permits the stopper 50 to have a force Fi against the collision with the sheet P is additionally applied to the motor 52 immediately before the collision.

The magnitude of the force Fi corresponds to the impact of the collision between the sheet P and the stopper 50. Therefore, the force Fi is calculated as follows.

$$Fi=Mp\times dv/dt=Sp\times Xp\times V1/ti \quad (1)$$

In the expression (1), Mp denotes the weight of the sheet P, V1 denotes the speed of the sheet P at the time of the collision, ti denotes the time of the collision, Sp denotes the area of the sheet (sheet size), and Xp denotes the grammage of the sheet P. The speed V1 of the sheet P at the time of the collision can be calculated as follows.

$$V1^2-V2^2=2g\times(L1+L2-Lp)$$

$$V1=\sqrt{(V2^2+2g\times(L1+L2-Lp))} \quad (2)$$

In the expression (2), V2 denotes the speed of the sheet P while passing through the entrance sensor 38 (sheet feeding speed), L2 denotes the distance between the pair of entrance rollers 22 and the entrance sensor 38, L1 denotes the distance between the entrance sensor 38 and the upper surface of the stopper 50, and Lp denotes the length (size in the sheet feeding direction) of the sheet P. Here, g denotes the acceleration of gravity. The stop position of the stopper 50 is variable in accordance with the sheet size, and therefore, the value of the distance L1 between the entrance sensor 38 and the upper surface of the stopper 50 changes in accordance with the sheet size.

As shown in FIG. 4, a specified time after the collision between the sheet P and the stopper 50, the force applied from the motor 52 to the stopper 50 becomes a value of F0+F1. The force F1 corresponds to the weight of the one sheet P and is shown as follows.

$$F1=Mp\times g \quad (3)$$

After the sheet P is stored in the stacker 23, when another sheet P enters the stacker 23, as shown in FIG. 4, the force applied from the motor 52 to the stopper 50 becomes a value of F0+Fi+F1. The specified time after that, the force applied from the motor 52 to the stopper 50 becomes a value of F0+F2. The force F2 corresponds to the weight of the two sheets P stored in the stacker 23. In this way, the force applied from the motor 52 to the stopper 50 becomes larger step by step as the number of sheets P stored in the stacker 23 increases. Further, only when a sheet P hits against the stopper 50, the force Fi is temporarily applied from the motor 52 to the stopper 50 in addition to the force F0 plus the force corresponding to the number of sheets P stored in the stacker 23. It is to be noted that "when a sheet P hits against the stopper 50" includes at least a moment of a collision between a sheet P and the stopper 50. Considering a control time required for an output of the force Fi in preparation for a collision between a sheet P and the stopper 50, "when a sheet P hits against the stopper 50" may be a specified period including the moment of the collision.

When the ejection sensor 42 detects ejection of the sheets P from the stacker 23, as shown in FIG. 4, the force applied from the motor 52 to the stopper 50 becomes F0. When the center stapling/folding process is no longer carried on, the stopper 50 is moved to an initial position, and the supply of electric current to the motor 52 is stopped.

Current Control of the Motor

As described above, the force applied from the motor 52 to the stopper 50 is changed in accordance with the sheet stacking state, etc. The changes are realized by increasing and decreasing the electric current supplied to the motor 52, which is controlled by the control unit 4. The operation of the control unit 4 to control the electric current supplied to the motor 52 is hereinafter described with reference to the drawings.

Figure 5:
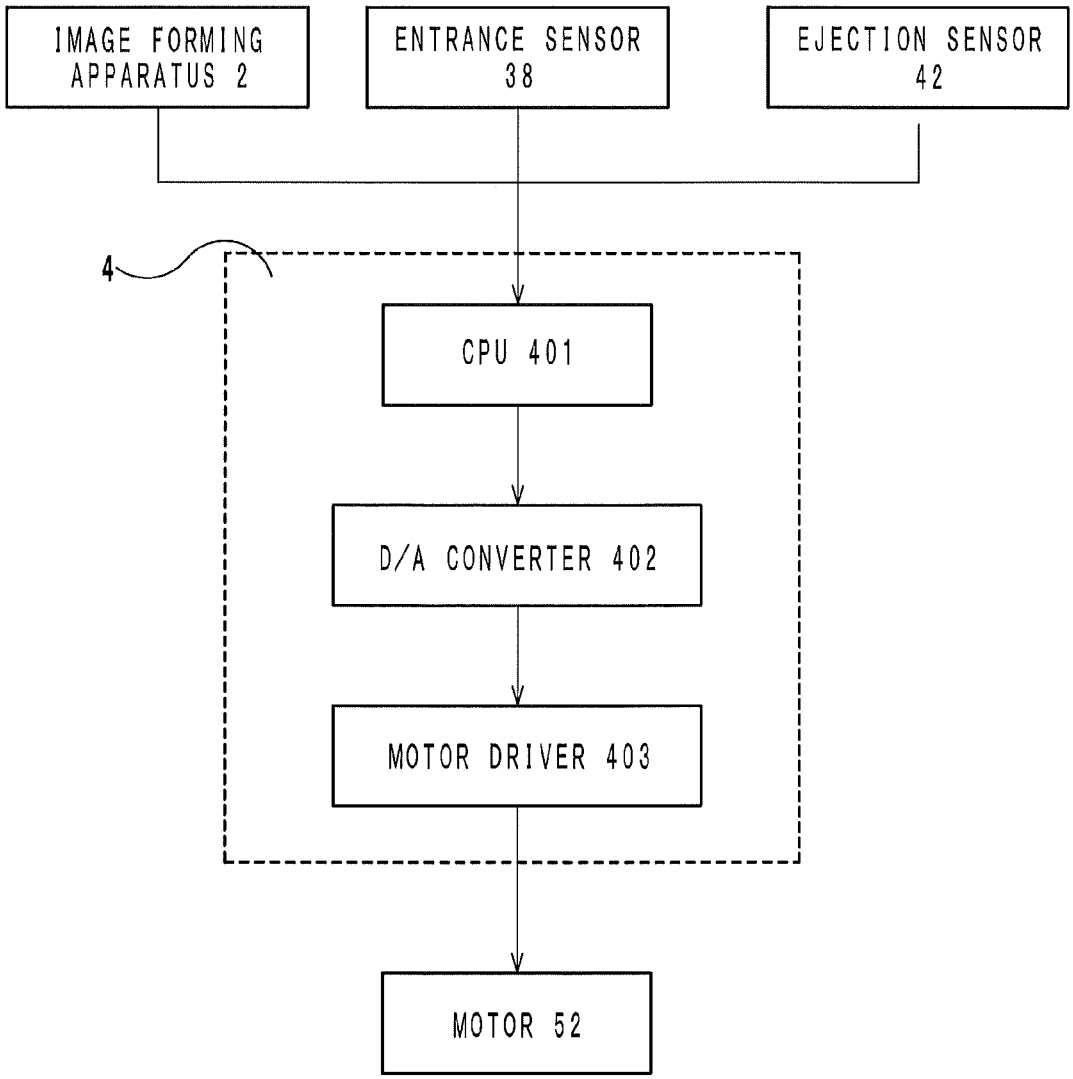
FIG. 5 is a block diagram of a part of a control unit for performing current control of the motor.

As shown by FIG. 5, the control unit 4 comprises a CPU 401, a D/A converter 402 and a motor driver IC403. According to the current control, first, the CPU 401 calculates a current value and a current-carrying timing, from information sent from the image forming apparatus 2, the entrance sensor 38 and the ejection sensor 42. At the current-carrying timing, the CPU 401 outputs digital data of a voltage value in proportion to the calculated current value to the D/A converter 402. Next, the D/A converter 402 converts the digital data into an analog voltage value and outputs the analog value to the motor driver IC 403. Further, the motor driver IC 403 operates to supply the motor 52 with an electric current of a value in proportion to the analog voltage value. When the CPU 401 incorporates the D/A converter, the CPU 401 may output the analog value to the motor driver 403 directly. In the following, the current control is described in more detail with reference to FIGS. 6 to 13.

Figure 6:
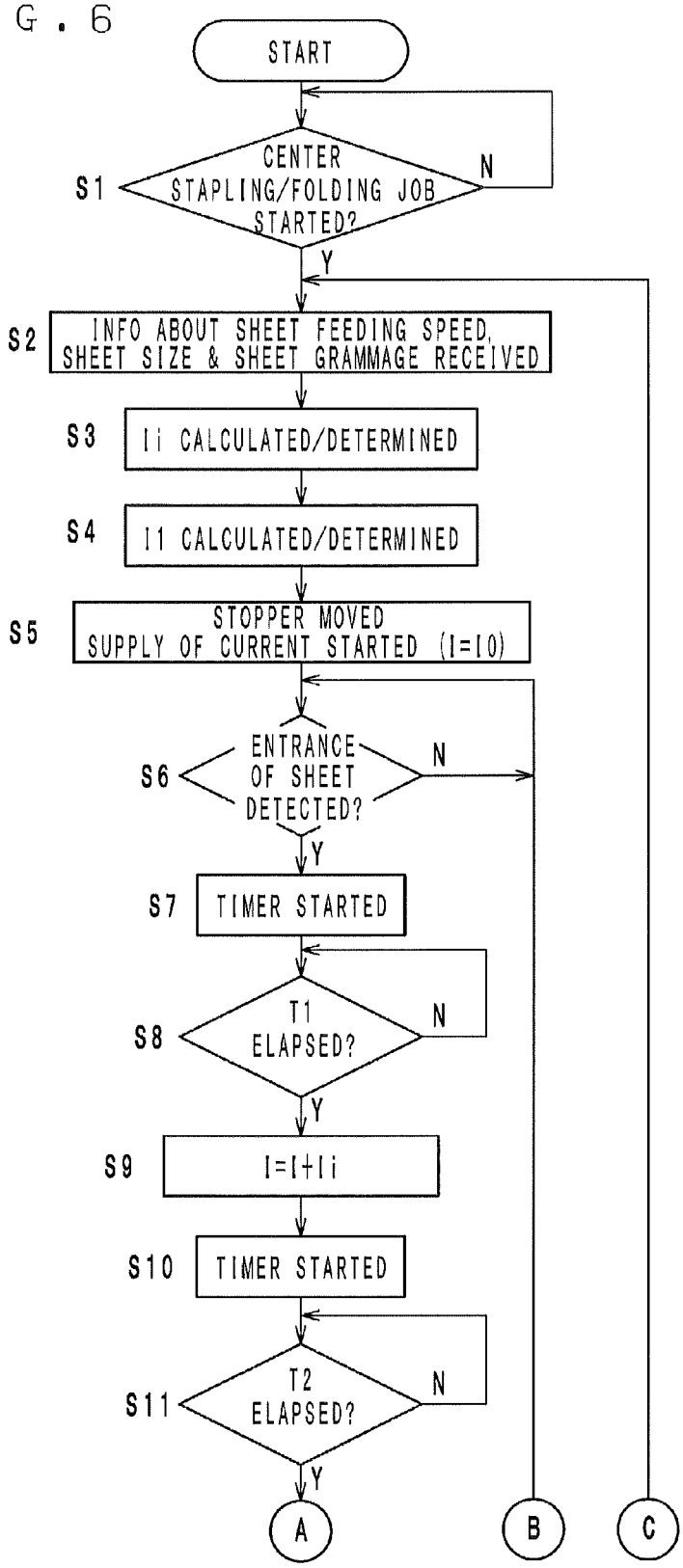
FIGS. 6 and 7 are flowcharts showing a current control process.
Figure 7:
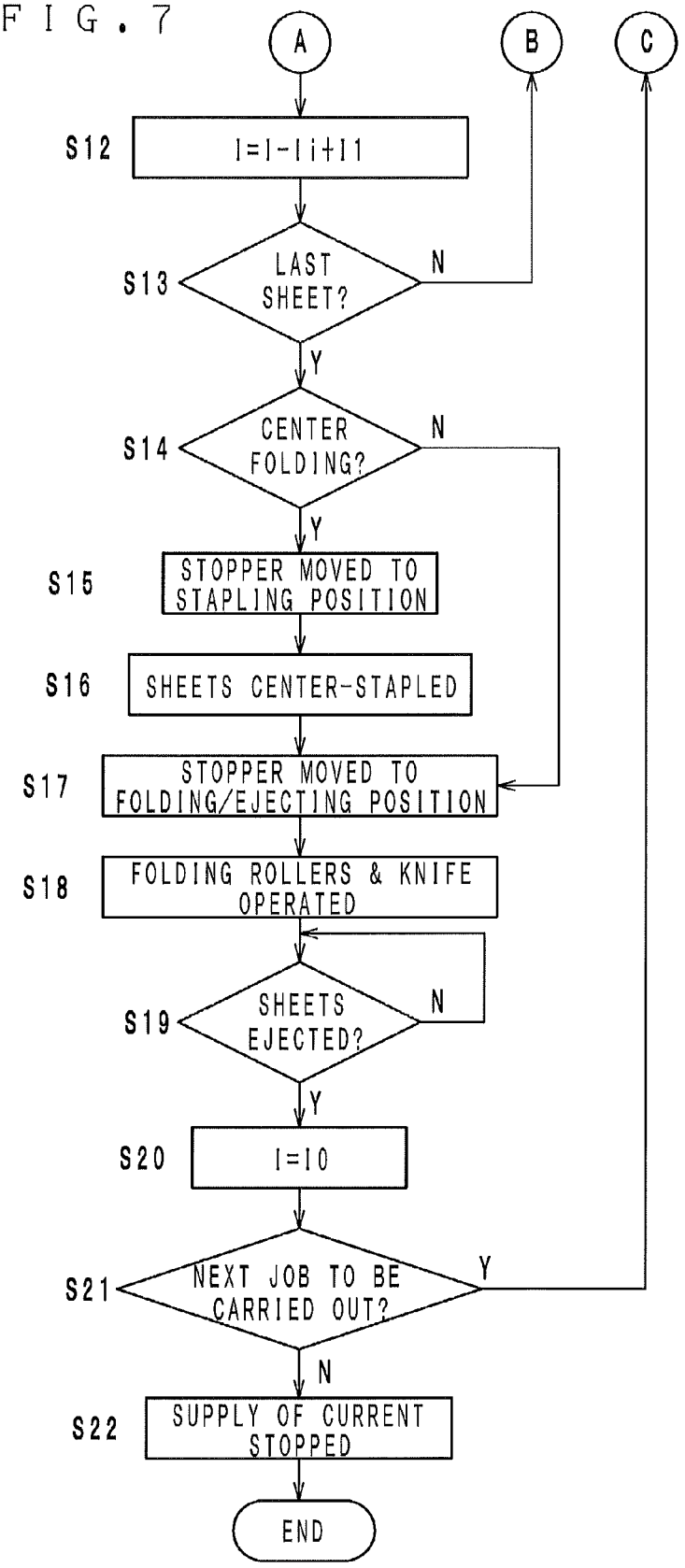

As shown in FIG. 6, at step S1, the control unit 4 judges whether a center stapling/folding job is to be carried out. For execution of a center stapling/folding job, the processing goes to step S2.

At step S2, the control unit 4 receives information about the speed (sheet feeding speed) V2, the sheet area (sheet size) Sp and the sheet grammage Xp.

Figure 8:
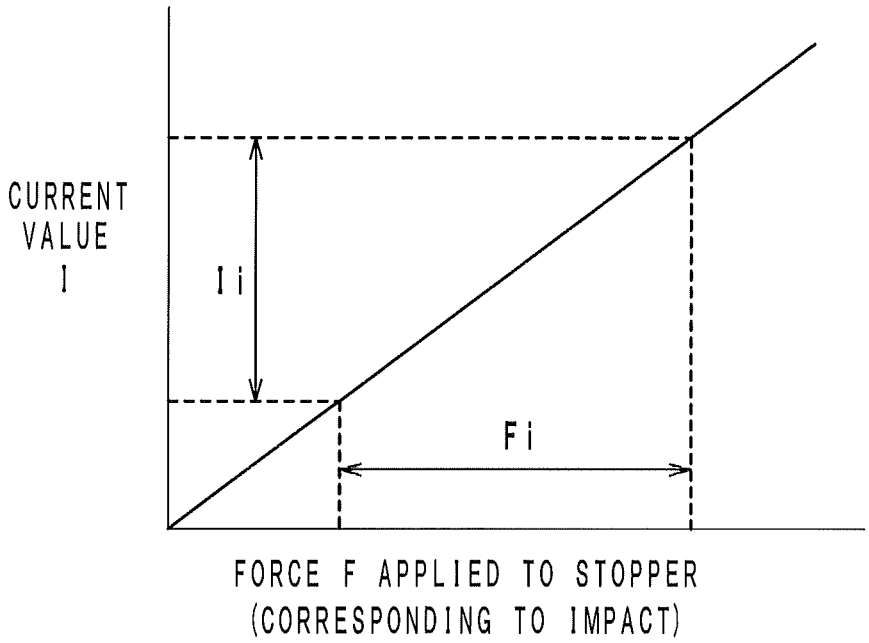
FIG. 8 is a graph showing a relation between the force applied to the stopper and the value of the current flowing in the motor.

At step S3, the control unit 4 calculates and determines a current value Ii. The current value Ii is an increment in current supplied to the motor 52 that is required when a sheet P hits against the stopper 50. Specifically, first, the control unit 4 calculates the force Fi from the information received at step S2 by using the expressions (1) and (2). The force Fi is an increment in force applied from the motor 52 to the stopper 50 when a sheet P hits against the stopper 50. Next, the control unit 4 calculates a torque Mi needed for the motor 52 to deliver the force Fi, from the force Fi and the structure of the drive force transmission 54. Then, the control unit 4 determines the current value Ii corresponding to the torque Mi, from the torque-current characteristic of the motor 52. In determining the current value Ii, it is possible to calculate the value Ii by making use of the fact that the force Fi applied to the stopper 50 is proportional to the current value Ii as shown by FIG. 8. Alternately, it is possible to determine the current value Ii depending on the sheet feeding speed, the sheet area and the sheet grammage by selecting a value from a table, such as a table shown in the lower level of FIG. 10.

Figure 11:
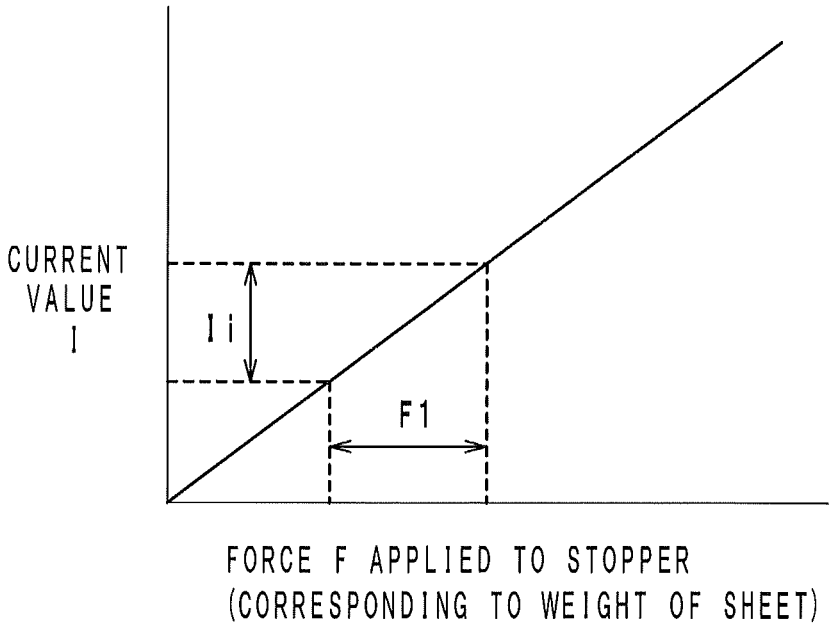
FIG. 11 is a graph showing a relation between the force applied to the stopper and the value of the current supplied to the motor.

At step S4, the control unit 4 calculates and determines a current value I1. The current value I1 is an increased amount of the current supplied to the motor 52 to cope with an increase of the number of sheets P stored in the stacker 23 by one, and the increase in the current by the value I1 is made the specified time after the collision of a sheet P with the stopper 50. Specifically, the control unit 4, first, calculates the force F1, which corresponds to the weight of one sheet P, from the information received at step S2 by using the expression (3). Next, the control unit 4 calculates a torque M1 needed for the motor 52 to deliver the force F1, from the force F1 and the structure of the drive force transmission 54. Then, the control unit 4 determines the current value I1 corresponding to the torque M1, from the torque-current characteristic of the motor 52. In determining the current value I1, it is possible to calculate the value I1 by making use of the proportional relationship between the force F applied to the stopper 50 and the current value I as shown by FIG. 11. Alternately, it is possible to determine the current value I1 depending on the sheet feeding speed, the sheet area and the sheet grammage by selecting a value from a table, such as a table shown in the lower level of FIG. 13.

At step S5, the control unit 4 operates to move the stopper 50 from the initial position in the stacker 23 to a stack position to permit sheets P to be stored in the stacker 23. In this moment, the control unit 4 operates to supply an electric current with a current value of I0 to the motor 52 to generate a torque to permit the motor 52 to deliver the force F0. The force F0 is a force corresponding to the weight of the stopper 50.

At step S6, the control unit 4 judges whether a sheet P comes into the center stapling/folding unit 15. Specifically, when the entrance sensor 38 detects the leading edge of a sheet P, the control unit 4 judges that the sheet P has come into the center stapling/folding unit 15. When the control unit 4 judges that a sheet P has come into the center stapling/folding unit 15, the processing goes to step S7.

At step S7, the control unit 4 starts a timer for measuring a time T1. The time T1 is a time period after the leading edge of a sheet P is detected by the entrance sensor 38 until the control unit 4 adds the current value Ii to the current supplied to the motor 52. The time T1 is a value of a time period Tk from the passing of the leading edge of the sheet P by the entrance sensor 38 to the collision of the sheet P with the stopper 50 minus a margin time Tm for absorbing a time error. Thus, the time T1 is expressed as follows.

$$T1=Tk-Tm \tag{4}$$

Tk is calculated from the following equation.

$$L1+L2-Lp=V2\times Tk+\tfrac{1}{2}gTk^2$$

Therefore, the expression (4) can be shown as follows.

$$T1=\sqrt{(V2^2+2g(L1+L2-Lp))}/g-V2/g-Tm \tag{5}$$

As mentioned above, V2 denotes the speed of the sheet P passing through the entrance sensor 38, and L1 denotes the distance between the entrance sensor 38 and the upper surface of the stopper 50.

At step S8, the control unit 4 judges whether the time period T1 has elapsed. When the elapse of the time period T1 is judged, the processing goes to step S9. When the elapse of the time period T1 is not judged, the processing returns to step S8. Thus, the control unit 4 waits until the time period T1 elapses.

Figure 9:
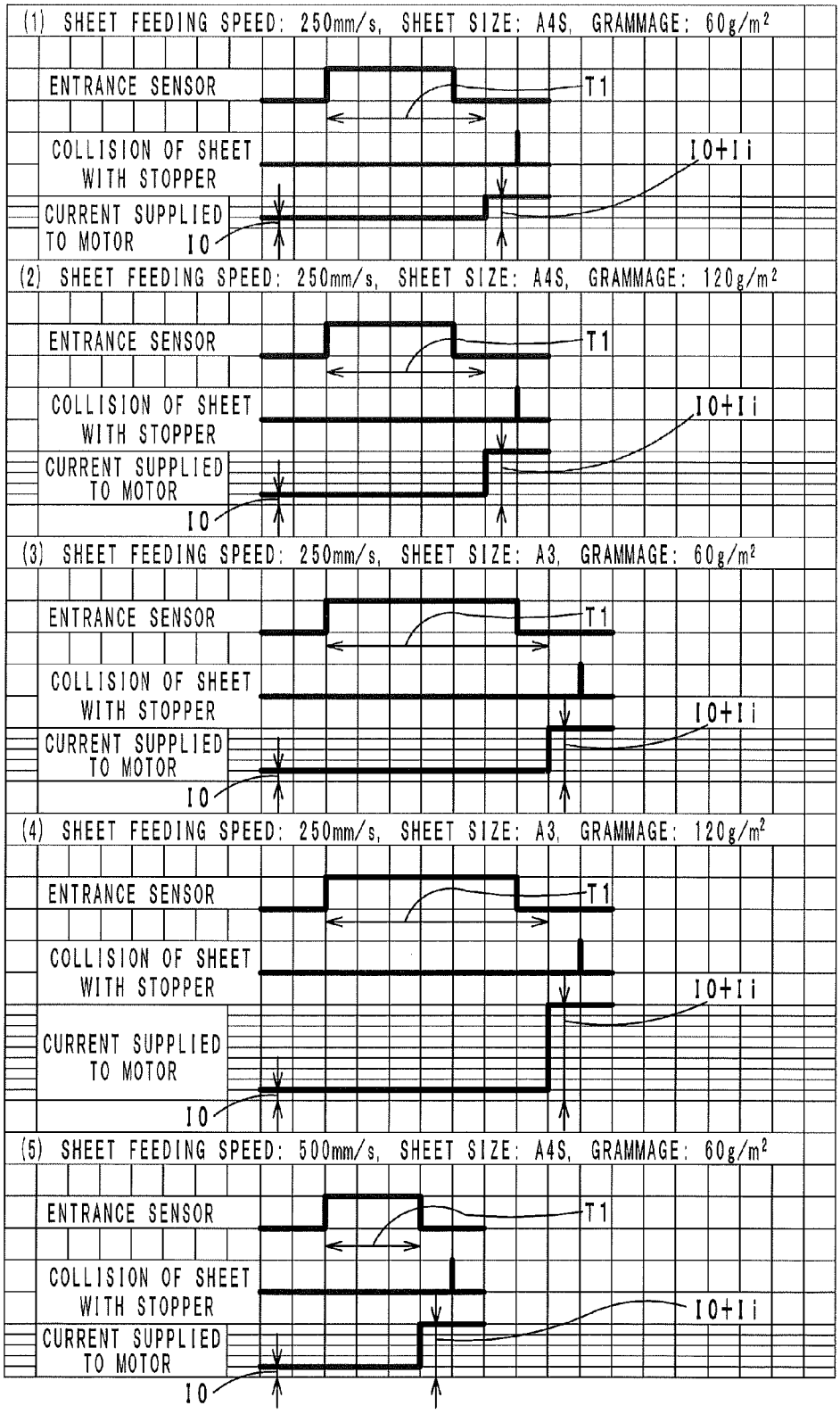
FIGS. 9 and 10 are timing charts showing the current control process for increasing the current supply.
Figure 10:
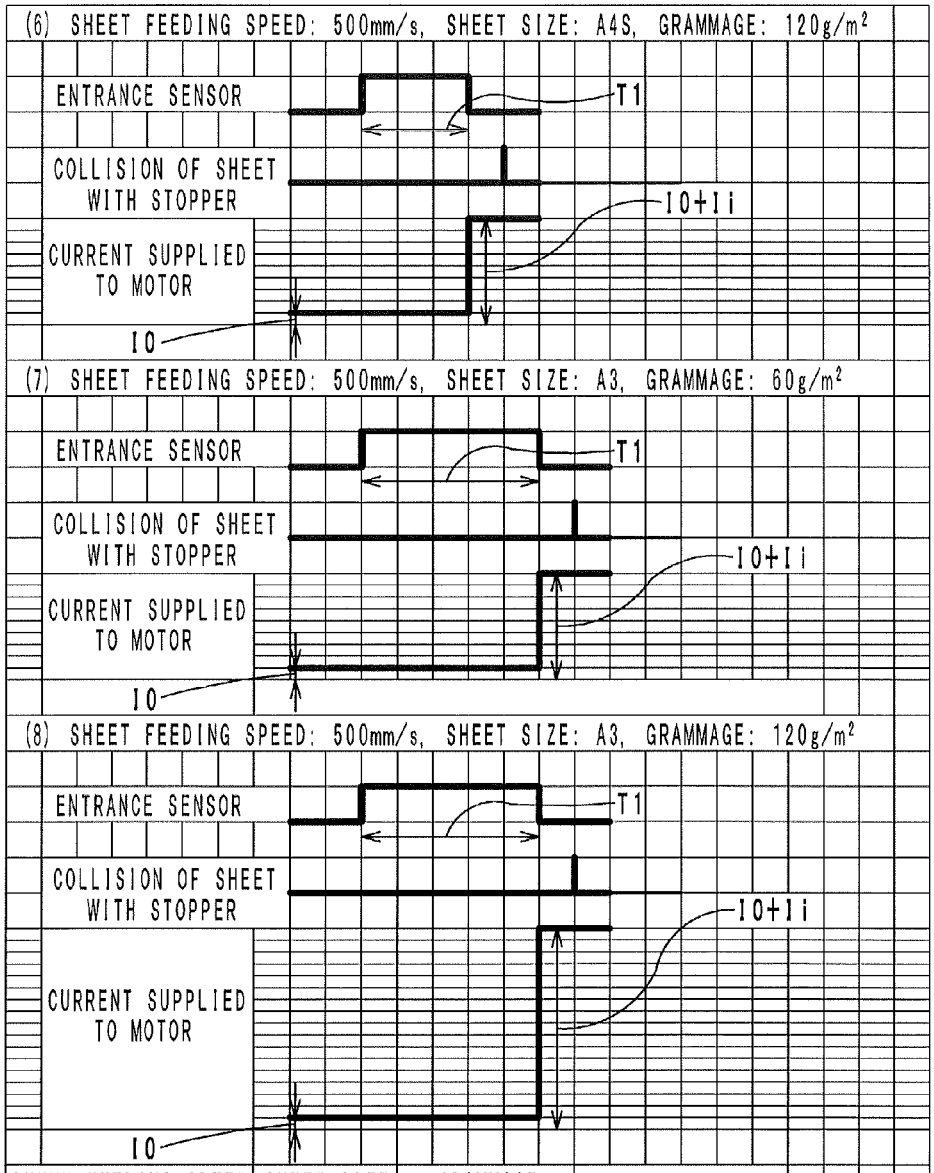

At step S9, the control unit 4 changes the value of the current supplied to the motor 52 in accordance with the speed, the area and the grammage of the sheet P, as shown by FIGS. 9 and 10. Specifically, the control unit 4 changes the value of the current supplied to the motor 52 from I0 to I0+Ii. In this way, the control unit 4 increases the current supplied to the motor 52 by the value Ii in preparation for the collision of the sheet P with the stopper 50.

At step S10, the control unit 4 starts a timer for measuring a time T2. The time T2 is a time period from the change of the current value from I0 to I0+Ii until a change of the current value from I0+Ii to I0+I1.

At step S11, the control unit 4 judges whether the time period T2 has elapsed. When the elapse of the time period T2 is judged, the process goes to step S12. When the elapse of the time period T2 is not judged, the process returns to step S11. Thus, the control unit 4 waits until the time period T2 elapses.

Figure 12:
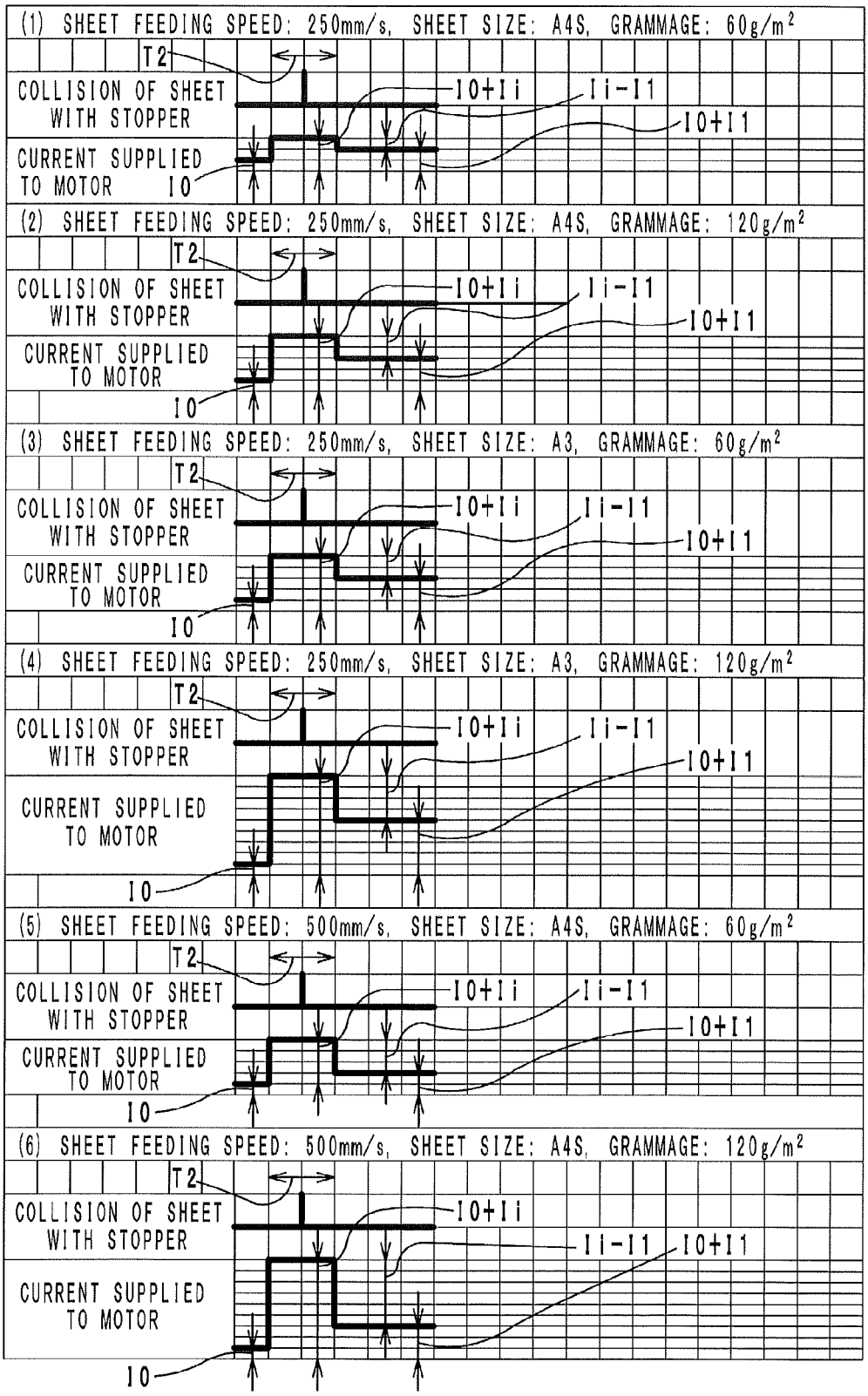
FIGS. 12 and 13 are timing charts showing the current control process for decreasing the current supply.
Figure 13:
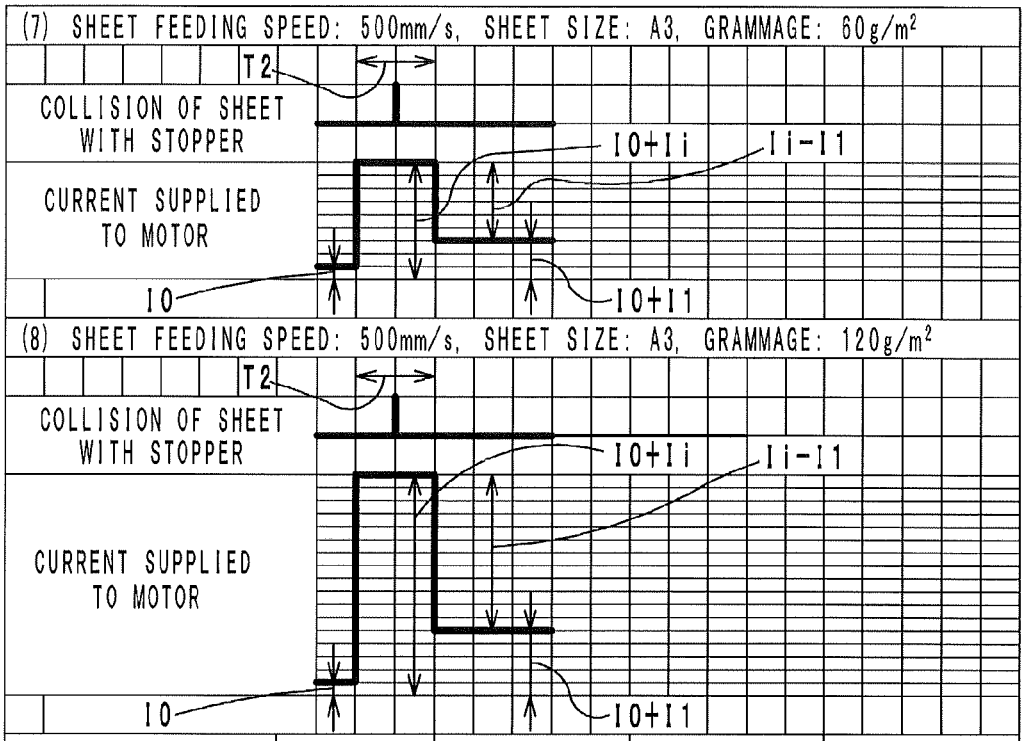

At step S12, the control unit 4 changes the value of the current supplied to the motor 52 in accordance with the speed, the area and the grammage of the sheet P, as shown by FIGS. 12 and 13. Specifically, the control unit 4 changes the value of the current supplied to the motor 52 from I0+Ii to I0+I1. The current value I1 is lower than the current value Ii. Therefore, what is actually carried out by the control unit 4 at step S12 is decreasing the value of the current supplied to the motor 52.

At step S13, the control unit 4 judges whether there is still any sheet P to come to the center stapling/folding unit 15, that is, whether the sheet P is the last sheet to be handled by the center stapling/folding unit 15. When the control unit 4 judges that there is still any sheet P to come to the center stapling/folding unit 15, the processing returns to step S6. When the control unit 4 judges that there is no other sheet P to come to the center stapling/folding unit 15, the processing goes to step S14.

At step S14, the control unit 4 judges whether the currently performed job is a center stapling and folding job or a center folding job. When it is judged that the currently performed job is a center stapling and folding job, the processing goes to step S15, and when it is judged that the currently performed job a center folding job, the processing goes to step S17.

At step S15, the control unit 4 drives the motor 52 to move the stopper 50 to a stapling position. The stapling position is a position of the stopper 50 to cause the centers of the sheets P in the sheet feeding direction to be positioned in the stapling position A.

At step S16, the control unit 4 commands the stapler 31 to staple the sheets P. After the stapling, the processing goes to step S17.

At step S17, the control unit 4 drives the motor 52 to move the stopper 50 to a folding/ejecting position. The folding/ejecting position is a position of the stopper 50 to cause the centers of the sheets P in the sheet feeding direction to be positioned in the folding position B.

At step S18, the control unit 4 commands the folding roller 35 and the folding knife 36 to start a folding operation. While undergoing the folding operation, the sheets P are ejected to the brochure tray 24.

At step S19, the control unit 4 judges whether the sheets P have been ejected from the stacker 23. Specifically, the ejection sensor 42 provided in the stacker 23 detects existence or non-existence of sheets P in the stacker 23. From the detection result, the control unit 4 judges whether the sheets P have been ejected from the stacker 23. When it is judged that the sheets P have been ejected from the stacker 23, the processing goes to step S20. When it is judged that the sheets P have not been ejected from the stacker 23, the processing returns to step S19, and the control unit 4 waits until the sheets P are ejected from the stacker 23.

At step S20, the control unit 4 changes the value of the current supplied to the motor 52 to JO. Thus, at timing based on the time when the ejection sensor 42 detects the non-existence of the sheets P in the stacker 23, the current supplied to the motor 52 is returned to the value before the collision of the first sheet P with the stopper 50.

At step S21, the control unit 4 judges whether another center stapling/folding job is to be performed. When the control unit 4 judges that another center stapling/folding job is to be performed, the processing goes to step S2. When the control unit 4 judges that no other center stapling/folding job is to be performed, the processing goes to step S22.

At step S22, the control unit 4 moves the stopper 50 to the initial position inside the stacker 23. After completion of the movement, the control unit 4 stops the supply of electric current to the motor 52. With this step, the processing is completed.

Advantageous Effects

Figure 14:
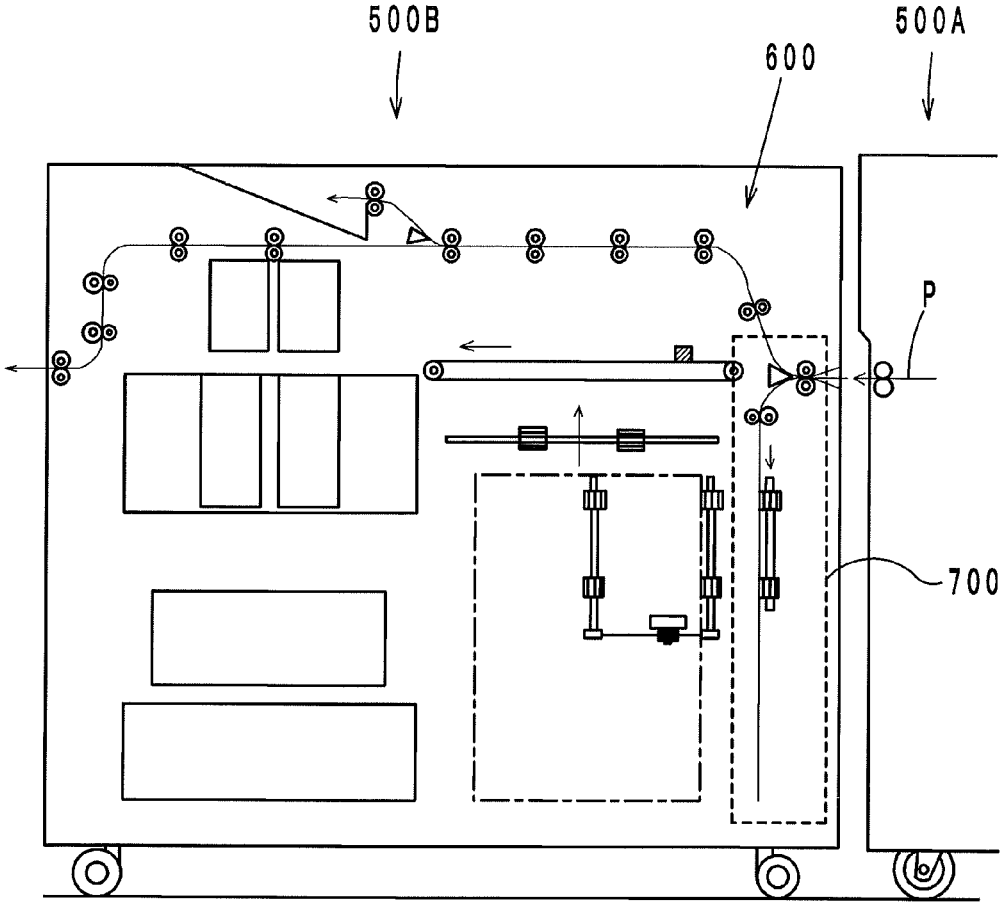
FIG. 14 PRIOR ART
FIG. 14 is a front view of a sheet post-processing apparatus of a same type as disclosed by Japanese Patent Laid-Open Publication No. 2005-314029.
Figure 15:
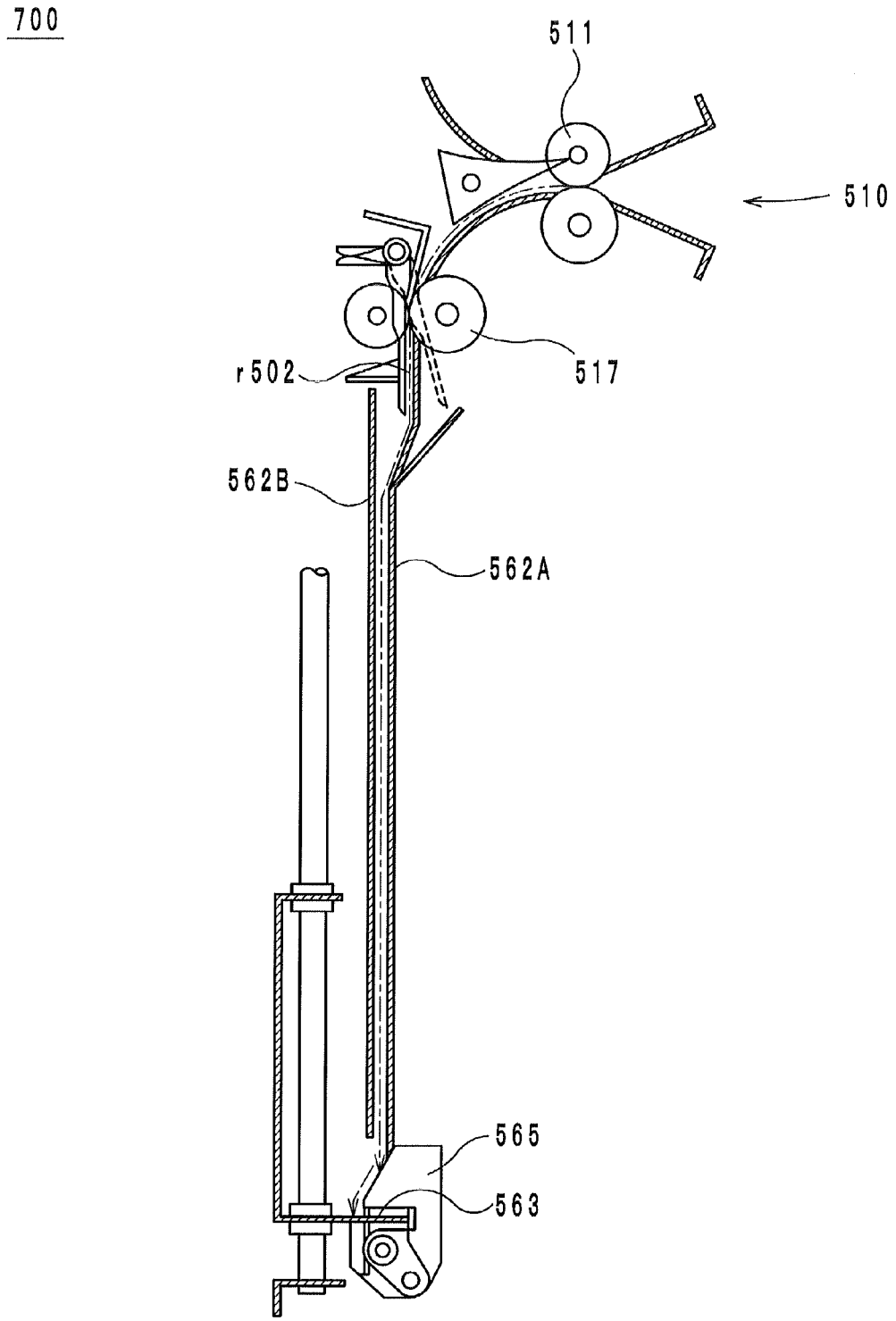
FIG. 15 PRIOR ART
FIG. 15 is a cross-sectional view of an intermediate stacker of a sheet post-processing apparatus of a same type as disclosed by Japanese Patent Laid-Open Publication No. 2005-314029.

In the post-processing apparatus 3 and in the image forming system 1 of the structure above, a sheet P ejected from the image forming apparatus 2 certainly reaches the stopper 50 provided in the stacker 23 for storing sheets P while the stopper 50 is prevented from sliding down. Specifically, every time a sheet P hits against the stopper 50, the force Fi is additionally applied from the motor 52 to the stopper 50 temporarily so as to withstand the impact of the sheet P. Therefore, the stopper 50 stays firmly in a stacking position to permit the sheets P to be stacked in the stacker 23. Thus, in the post-processing apparatus 3 and in the image forming system 1, a fall of the stopper 50 possibly caused by the collision of each sheet P with the stopper 50 can be prevented. In the post-processing apparatus 3 and in the image forming apparatus 1, there are provided no members like the friction member 565 in the sheet post-processing apparatus 500B shown by FIGS. 14 and 15. Therefore, in the image forming system 1 and in the post-processing apparatus 3, a printed sheet P entering the stacker 23 reaches the stopper 50 with no fault. In the post-processing apparatus 3 and in the image forming system 1, since the number of components decreases, the structure of the stacker 23 can be simplified, and the space occupied by the center stapling/folding unit 15 in the post-processing apparatus 3 can be reduced.

In the post-processing apparatus 3 and in the image forming system 1, further, the current supplied to the motor 52 is increased only when necessary. Therefore, in the post-processing apparatus 3 and in the image forming system 1, the power consumption can be reduced, and temperature rise of the motor 52 can be avoided.

In the post-processing apparatus 3 and in the image forming system 1, since the power consumption is small, the size of the power source unit can be reduced.

In the post-processing apparatus 3 and in the image forming system 1, the force for supporting the stopper 52 is determined depending on the speed V2 (sheet feeding speed), the area Sp and the grammage Xp of the sheet P, and therefore, the sheets P can be positioned in the stacker 23 more correctly compared with in the sheet post-processing apparatus 500B disclosed by Japanese Patent Laid-Open Publication No. 2005-314029.

OTHER EMBODIMENTS

Post-processing apparatuses and image forming systems according to the present invention are not limited to the embodiments above. For example, the structure of the tray for stacking and storing a plurality of sheets, and the structures and shapes of the folding roller and the folding knife may be arbitrarily designed.

In the post-processing apparatus 3 and the image forming system 1 according to an embodiment of the present invention, the control unit 4 is provided in the post-processing apparatus 3. However, the control unit 4 may be provided in the image forming apparatus 2.

Although the present invention has been described in connection with the preferred embodiments above, it is to be noted that various changes and modifications are possible for a person skilled in the art. Such changes and modifications are to be understood as being within the scope of the present invention.

What is claimed is:

1. A post-processing apparatus configured to collect printed sheets ejected from an image forming apparatus and to handle the printed sheets, the post-processing apparatus comprising:

a stacker configured to collect and stack a plurality of printed sheets with one end of each of the printed sheets placed down;

a movable stopper configured to stop each of the printed sheets sliding down in the stacker at a specified position;

a motor configured to move the stopper along the stacker and stop the stopper; and a control unit configured to control the motor, wherein the control unit increases a current supplied to the motor in preparation for a collision between each of the printed sheets and the stopper.

2. The post-processing apparatus according to claim 1, wherein the motor is a stepping motor.

3. The post-processing apparatus according to claim 1, further comprising an entrance sensor configured to detect each of the printed sheets entering the stacker, wherein the control unit determines a time to increase the current supplied to the motor based on a time of detection by the entrance sensor.

4. The post-processing apparatus according to claim 1, wherein the current supplied to the motor is increased by an amount variable in accordance with a kind of the printed sheets.

5. The post-processing apparatus according to claim 1, wherein the control unit decreases the current supplied to the motor by a specified amount a specified time after the collision between each of the printed sheets and the stopper.

6. The post-processing apparatus according to claim 5, wherein the specified amount by which the current supplied to the motor is decreased the specified time after the collision between each of the printed sheets and the stopper is variable in accordance with a weight of printed sheets stacked in the stacker.

7. The post-processing apparatus according to claim 1, further comprising an ejection sensor configured to detect ejection of the printed sheets from the stacker, wherein the control unit returns the current supplied to the motor to a value before the collisions between the respective sheets and the stopper at timing based on a time of detection by the ejection sensor.

8. The post-processing apparatus according to claim 7, further comprising a center stapling/folding unit configured to center-staple and/or center-fold the printed sheets, wherein the ejection sensor is located in an ejection path leading from the center stapling/folding unit to an ejection port of the post-processing apparatus; and wherein the ejection sensor detects separation of the printed sheets from the stopper when an edge of the printed sheets passes the ejection sensor.

9. An image forming system comprising:

an image forming apparatus configured to form images on a plurality of printed sheets sequentially;

a post-processing apparatus configured to collect printed sheets ejected from an image forming apparatus and to handle the printed sheets, the post-processing apparatus comprising a stacker configured to collect and stack a plurality of printed sheets with one end of each of the printed sheets placed down, a movable stopper configured to stop each of the printed sheets sliding down in the stacker at a specified position, and a motor configured to move the stopper along the stacker and stops the stopper; and a control unit configured to control the motor, wherein the control unit increases a current supplied to the motor in preparation for a collision between each of the printed sheets and the stopper.

10. The image forming system according to claim 9, wherein the motor is a stepping motor.

11. The image forming system according to claim 9, wherein the post-processing apparatus further comprises an entrance sensor configured to detect each of the printed sheets entering the stacker; and wherein the control unit determines a time to increase the current supplied to the motor based on a time of detection by the entrance sensor.

12. The image forming system according to claim 9, wherein the current supplied to the motor is increased by an amount variable in accordance with a kind of the printed sheets.

13. The image forming system according to claim 9, wherein the control unit decreases the current supplied to the motor by a specified amount a specified time after the collision between each of the printed sheets and the stopper.

14. The image forming system according to claim 13, wherein the specified amount by which the current supplied to the motor is decreased the specified time after the collision between each of the printed sheets and the stopper is variable in accordance with a weight of printed sheets stacked in the stacker.

15. The image forming system according to claim 9, wherein the post-processing apparatus further comprises an ejection sensor configured to detect ejection of the printed sheets from the stacker; and wherein the control unit returns the current supplied to the motor to a value before the collisions between the respective sheets and the stopper at timing based on a time of detection by the ejection sensor.

16. The image forming system according to claim 15, wherein the post-processing apparatus further comprises a center stapling/folding unit configured to center-staple and/or center-fold the printed sheets;

wherein the ejection sensor is located in an ejection path leading from the center stapling/folding unit to an ejection port of the post-processing apparatus; and wherein the ejection sensor detects separation of the printed sheets from the stopper when an edge of the printed sheets passes the ejection sensor.

* * * * *